US006755886B2

(12) United States Patent
Phillips et al.

(10) Patent No.: US 6,755,886 B2
(45) Date of Patent: Jun. 29, 2004

(54) METHOD FOR PRODUCING METALLIC MICROPARTICLES

(75) Inventors: Jonathan Phillips, Santa Fe, NM (US); William L. Perry, Albuquerque, NM (US); William J. Kroenke, Albuquerque, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/126,039

(22) Filed: Apr. 18, 2002

(65) Prior Publication Data

US 2003/0196513 A1 Oct. 23, 2003

(51) Int. Cl.[7] ..... B22F 9/14
(52) U.S. Cl. ..... 75/346; 75/367
(58) Field of Search ..... 75/346, 367, 336, 75/10.19, 10.21; 419/52, 66

(56) References Cited

U.S. PATENT DOCUMENTS

| | | | | |
|---|---|---|---|---|
| 3,655,838 A | | 4/1972 | Reed et al. | 264/6 |
| 4,246,208 A | | 1/1981 | Dundas | 264/14 |
| 4,627,943 A | | 12/1986 | Seidler | 264/14 |
| 4,731,110 A | | 3/1988 | Kopatz et al. | 75/0.5 A |
| 4,731,111 A | | 3/1988 | Kopatz et al. | 75/0.5 A |
| 4,778,517 A | | 10/1988 | Kopatz et al. | 75/0.5 A |
| 4,892,579 A | * | 1/1990 | Hazelton | 75/367 |
| 5,114,471 A | | 5/1992 | Johnson et al. | 75/346 |
| 5,460,701 A | * | 10/1995 | Parker et al. | 75/10.19 |
| 5,514,350 A | | 5/1996 | Kear et al. | 422/198 |
| 5,770,126 A | * | 6/1998 | Singh et al. | 75/333 |
| 5,989,648 A | | 11/1999 | Phillips | 427/456 |
| 6,159,267 A | | 12/2000 | Hampden-Smith et al. | 75/252 |
| 6,171,704 B1 | | 1/2001 | Mosser et al. | 428/450 |
| 6,261,484 B1 | | 7/2001 | Phillips et al. | 264/5 |
| 6,277,774 B1 | * | 8/2001 | Xiao et al. | 501/12 |
| 2002/0037320 A1 | * | 3/2002 | Denes et al. | 424/489 |

OTHER PUBLICATIONS

Mark J. Hampden–Smith et al., "Palladium–Containing Particles Method and Apparatus of Manufacture, Palladium–Containing Devised Made Therefrom," U.S. Patent 6,159,267 issued Dec. 12, 2000.

C.G. Granqvist and R.A. Buhram, "Ultrafine Metal Particles," Journal of Applied Physics, vol. 47, No. 5, pp. 2200–2219, May 1976.

T. Uchikoshi, Y. Sakka, M. Yoshitake, and K. Yoshibara," A Study of the Passivating Oxide Layer on Fine Nickel Particles," NanoStructured Materials, vol. 4, No. 2, pp. 199–206, 1994.

H. Gleiter, "Materials with Ultrafine Microstructures: Retrospectives and Perspectives," NanoStructured Materials, vol. 1, pp. 1–19, 1992.

W. Lee Perry, D. Wayne Cooke, and Joel D. Katz, Abhaya K. Datye, "One the Possibility of a Significant Temperature Gradient in Supported Metal Catalysts Subjected to Microwave Heating," Catalysis Letters, vol. 47, pp. 1–4, 1997.

S. Panda and S.E. Pratsinis, "Modeling the Synthesis of Aluminum Particles by Evaporation–Condensation in an Aerosol Flow Reactor," NanoStructured Materials, vol. 5, Nos. 7/8, pp. 755–767, 1995.

(List continued on next page.)

*Primary Examiner*—George Wyszomierski
(74) *Attorney, Agent, or Firm*—Samuel L. Borkowsky

(57) ABSTRACT

Method for producing metallic particles. The method converts metallic nanoparticles into larger, spherical metallic particles. An aerosol of solid metallic nanoparticles and a non-oxidizing plasma having a portion sufficiently hot to melt the nanoparticles are generated. The aerosol is directed into the plasma where the metallic nanoparticles melt, collide, join, and spheroidize. The molten spherical metallic particles are directed away from the plasma and enter the afterglow where they cool and solidify.

13 Claims, 6 Drawing Sheets

OTHER PUBLICATIONS

C. H. Chow et al., "Platinum Metal Etching in a Microwave Oxygen Plasma," j. Appl. Phys. vol. 68, No. 5, pp. 2415–2423, 1990.

T. Uchikoshi, Y. Sakka, M. Yoshitake, and K. Yoshihara, "A Study of the Passivating Oxide Layer on Fine Nickel Particles," NanoStructured Materials, vol. 4, No. 2, pp. 199–206, 1994.

K. Recknagle, Q. Xia, J.N. Chung, C.T. Crowe, H. Hamilton, "Properties of Nanocrystalline Zinc Produced by Gas Condensation,." NanoStructured Materials, vol. 4, No. 1, pp. 103–111, 1994.

P.J. Herley and W. Jones, "Nanoparticle Generation by Electron Beam Induced Atomization of Binary Metal Azides," NanoStructured Materials, vol. 2, pp. 553–562, 1993.

D. Vollath, K.E. Sickafus," Synthesis of Nanosized Ceramic Nitride Powders by Microwave Supported Plasma Reactions," NanoStructured Materials, vol. 2, pp. 451–456, 1993.

J.A. Eastman, L.J. Thompson, and D.J. Marshall, "Synthesis of Nanophase Materials by Electron Beam Evaporation," NanoStructured Materials, vol. 2, pp. 377–382, 1993.

V. Hass and R. Birringer, "The Morphology and Size of Nanostructured Cu, Pd, and W Generated by Sputtering," NanoStructured Materials, vol. 1, pp. 491–504, 1992.

Dieter Vollath and Kurt E. Sickafus, "Synthesis of Nanosized Ceramic Oxide Powders by Microwave Plasma Reactions," NanoStructured Materials, vol. 1, pp. 427–437, 1992.

H.J. Fecht, "Synthesis and Properties of Nanocrystalline Metals and Alloys Prepared by Mechanical Attrition, "NanoStructured Materials, vol. 1, pp. 125–130, 1992.

S. Iwama and K. Hayakawa, "Vaporization and Condensation of Metals in a Flowing Gas with High Velocity," vol. 1, pp. 113–118, 1992.

G. Skandan, Y–J. Chen, N. Glumac, and B.H. Kear, "Synthesis of Oxide Nanoparticles in Low Pressure Flames, "NanoStructured Materials, vol. 11, No. 2, pp. 149–158, 1999.

J.R. Brenner, J.B.L. Harkness, M.B. Knickelbein, G.K. Krumdick, and C.L. Marshall, "Microwave Plasma Synthesis of Carbon–Supported Ultrafine Matal Particles," NanoStructured Materials, vol. 8, No. 1, pp. 1–17, 1997.

Guixiang Yang, Haoren Zhuang, and Pratim Biswas, "Characterization and Sinterability of nanophase Titania Particles Processed in Flame Reactors," NanoStructured Materials, vol. 7, No. 6, pp. 675–689, 1996.

T. Yamamoto and J. Mazumder, Synthesis of Nanocrystalline $NbA1_3$ by Lazer Ablation Technique, vol. 7, No. 3, pp. 305–312, 1996.

ChinHao Chou and Jonathan Phillips, "Plasma Production of Metallic Nanoparticles," J. Mater. Res., vol. 7, No. 8, pp. 2107–2113, 1992.

J.P. Chen, C.M. Sorensen, and K.J. Klabunde, "Enhanced Magnetization of Nanoscale Colloidal Cobalt Particles, "The American Physical Society, vol. 51, No. 17, pp. 527–532, May 1995.

Wei Gong, Hua Li, Zhongren Zhao, and Jinchang Chen, "Ultrafine Particles of Fe, Co, and Ni Ferromagnetic Metals, "J. Appl. Phys, Vol, 69, No. 8, pp. 5119–5121, Apr. 1991.

Tetsuro Majima, Tesshu Miyahara, Koichi Haneda, Tadahiro Ishii, and Michio Takami, "Preparation of Iron Ultrafine Particles by the Dielectric Breakdown of Fe (CO)5 Using a Transversely Excited Atmospheric Co2 Laser and Their Characteristics, "J. Appl. Phys., vol. 33, part 1, No. 8, pp. 4759–4763, Aug. 1994.

A. Chatterjee and D. Chakravorty, "Preparation of Nickel Nanoparticles by Metalorganic Route, " Appl. Phys. Lett., vol. 60 , No. 1, pp. 138–140, Jan. 1992.

Yoshiaki Sawada, Yoshiteru Kageyama, Massashi Iwata, and Akira Tasaki, "Synthesis and Magnetic Properties of Ultrafine Iron Particles Prepared by Pyrolysis of Carbonyl Iron, " Jpn. J. Appl. Phys., vol. 31, part 1, No. 12A, pp. 3858–3861, Dec. 1992.

H. Shim and J. Phillips, "Resstructuring of Alimina Particles Using a Plasma Torch, " J. Mater. Res., vol. 14, No. 3, pp. 849–854, Mar. 1999.

Chun–Ku Chen, Seth Gleiman, and Jonathan Phillips, "Low–Power Plasma Torch Method for tghe Production of Crystalline Sperical Ceramic Particles," J. Mater. Res., vol. 16, No 5, pp. 1256–1265, May 2001.

* cited by examiner

METHOD FOR PRODUCING METALLIC MICROPARTICLES

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to metallic particles and more particularly, to a plasma-based method of producing a narrow distribution of spherical, metallic microparticles from smaller metallic nanoparticles.

BACKGROUND OF THE INVENTION

The standard technology for producing aluminum particles in the 1–10 micron size diameter range, which may be optimal for metallic paints, involves converting larger metallic particles into smaller ones by wet the ball milling of the larger particles. Wet ball milling is an inefficient method of providing particles in this size range because only about 20% of the particles produced by wet ball milling are less than 10 microns and this minor fraction must be physically separated from the rest of the wet-ball milled product. A more efficient method for producing metallic particles in the optimal size range remains desirable.

Therefore, an object of the present invention is to provide an efficient method for producing high purity metallic particles of an optimal size range.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes method for producing metallic particles from smaller metallic nanoparticles. The method includes generating an aerosol of precursor solid metallic nanoparticles, generating a non-oxidizing plasma having a hot zone with a temperature sufficiently high to melt the precursor nanoparticles and directing the aerosol into the hot zone. In the hot zone, the precursor nanoparticles melt, collide, join, spheroidize and become larger molten, spherical metallic particles. The larger, molten, spherical metallic particles are directed away from the hot zone so that they cool and solidify to form solid, spherical, metallic particles that are larger than the precursor nanoparticles.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION OF THE INVENTION

Figure 1:
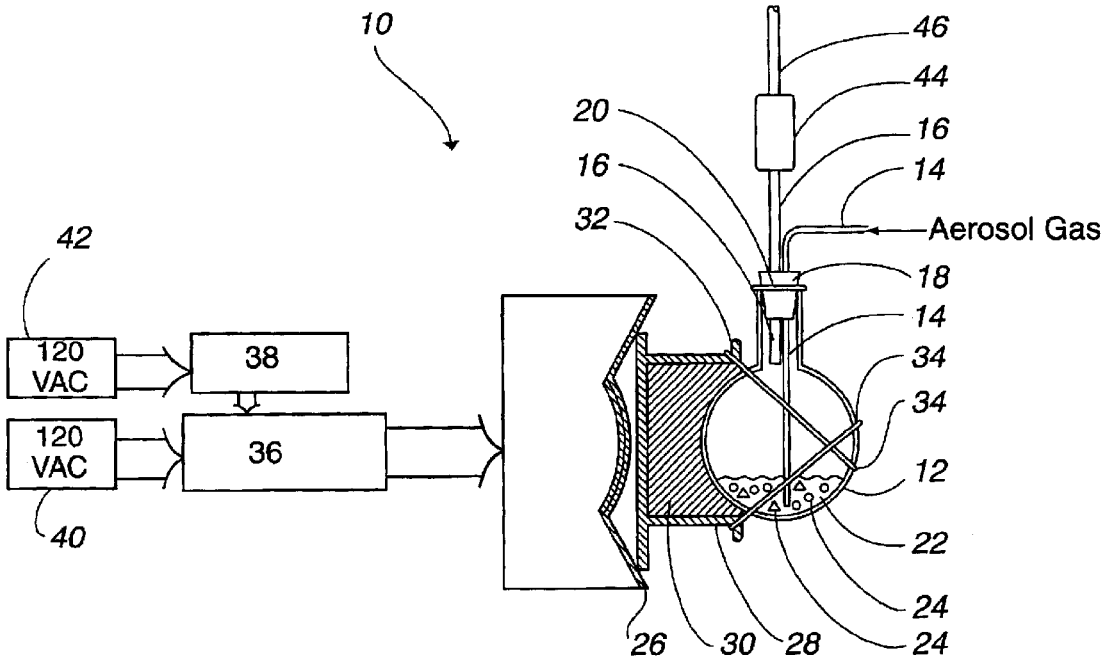
FIG. 1 shows a schematic representation of a particle feeder that produces a metallic nanoparticle aerosol and delivers it to a plasma torch.

The present invention includes a plasma-based method for converting small metallic particles into larger, mostly micron-size metallic particles (i.e. microparticles). The invention provides a narrow distribution of these larger metallic particles directly from smaller nanoparticles. Nanoparticles are defined herein as particles having a diameter of at least 1 nanometer (nm) but less than about 1 micron. Microparticles are defined herein as particles having a diameter of at least 1 micron but less than about 1000 microns.

The invention is useful for preparing metallic particles having a diameter of about 500 nm to about 1000 microns from smaller precursor metallic nanoparticles, and particularly useful for preparing aluminum particles (e.g. aluminum) having a diameter of about 0.5–3 microns from smaller precursor aluminum nanoparticles.

The invention employs a plasma torch apparatus that couples microwave energy from a microwave field to a flowing plasma gas stream to generate a stationary plasma with extreme axial temperature gradients. The plasma gas and precursor metallic particles entrained in the gas absorb energy directly from the microwave field. The intense power deposition produces heating and re-cooling rates of particles and gas as high as $10^5$ K/s.

Portions of the plasma torch apparatus used with the invention have been described previously (see, for example: H. Shim et al., "Restructuring of Alumina particles Using a Plasma Torch", *J. Mat. Res.*, volume 14, page 849 (1999); C-K Chen et al. J. Mat. Res., vol. 16, p. 1256, (2001); U.S. Pat. No. 5,989,648 to J. Phillips entitled "Plasma Generation of Supported Metal Catalysts," issued on Nov. 23, 1999; and U.S. Pat. No. 6,261,484, to Phillips et al. entitled "Method for Producing Ceramic Particles and Agglomerates," all incorporated by reference herein). Briefly, the apparatus includes an Astex magnetron (Woburn, Mass.) that generates 2.54 GHz microwaves and a coupler that surrounds the field region where the plasma is generated. The field region is about 5-cm in height for this apparatus. The apparatus also includes a standard WR-289 waveguide in the TE10 mode that transmits the microwaves (<1.5 kW) from the magnetron to the field region, and a 19-mm outer diameter (OD) quartz tube at the coupler end of the waveguide. A three-stub tuner transfers nearly 100% of the microwave power (<1.5 kW) from the magnetron to the plasma gas.

Microwave energy transferred to the field region accelerates free electrons in the field region. The accelerated electrons transfer kinetic energy to plasma gas, which ionizes into plasma and free electrons. Heating via direct absorption of energy by conduction electrons of metal particles entrained in the plasma gas is likely insignificant (see W. Lee Perry et al. Catalysis Letters, vol. 47, pp. 1–4, 1997). As metallic particles traverse the field region, these conduction electrons absorb energy directly from the plasma; the particles melt rapidly, collide and agglomerate, i.e. join together to form larger particles. After reaching a maximum desired size, they exit the field region and enter the afterglow, where they cool down and solidify.

The residence time of particles in the plasma, the particle density in the aerosol, and the microwave power supplied to create the plasma, are controllable parameters that are adjusted to produce metallic particles of a desired ultimate particle size and overall particle size distribution. The microwave power influences the size and temperature of the plasma. The present invention is a method for growing larger particles from smaller ones, and the microwave power used should be sufficient to melt the particles so that they can then agglomerate (e.g. 200–300 Watts for aluminum), but not make them smaller by, for example, atomizing them. Preferred conditions are those that produce completely molten particles in the field region because completely molten particles are more likely to agglomerate than partially molten particles or solid particles.

In practice, the product particle size and overall product particle size distribution are controlled by properly adjusting the residence time, the collision rate, and the length and maximum temperature of the plasma. The residence time is controlled by adjusting the primary flow rate and the injector flow rate. The collision rate is controlled by adjusting the input particle density.

The rate of agglomeration in the field region and the rate of solidification in the afterglow contribute to the ability to control the microparticle size and size distribution. The steep temperature gradients in the field region and in the afterglow ensure that that entrained particles melt rapidly in the field region and solidify rapidly in the afterglow. It is believed that within about 0.2 seconds of exiting the field region, molten particles and gas cool in the afterglow to nearly room temperature.

Figure 2:
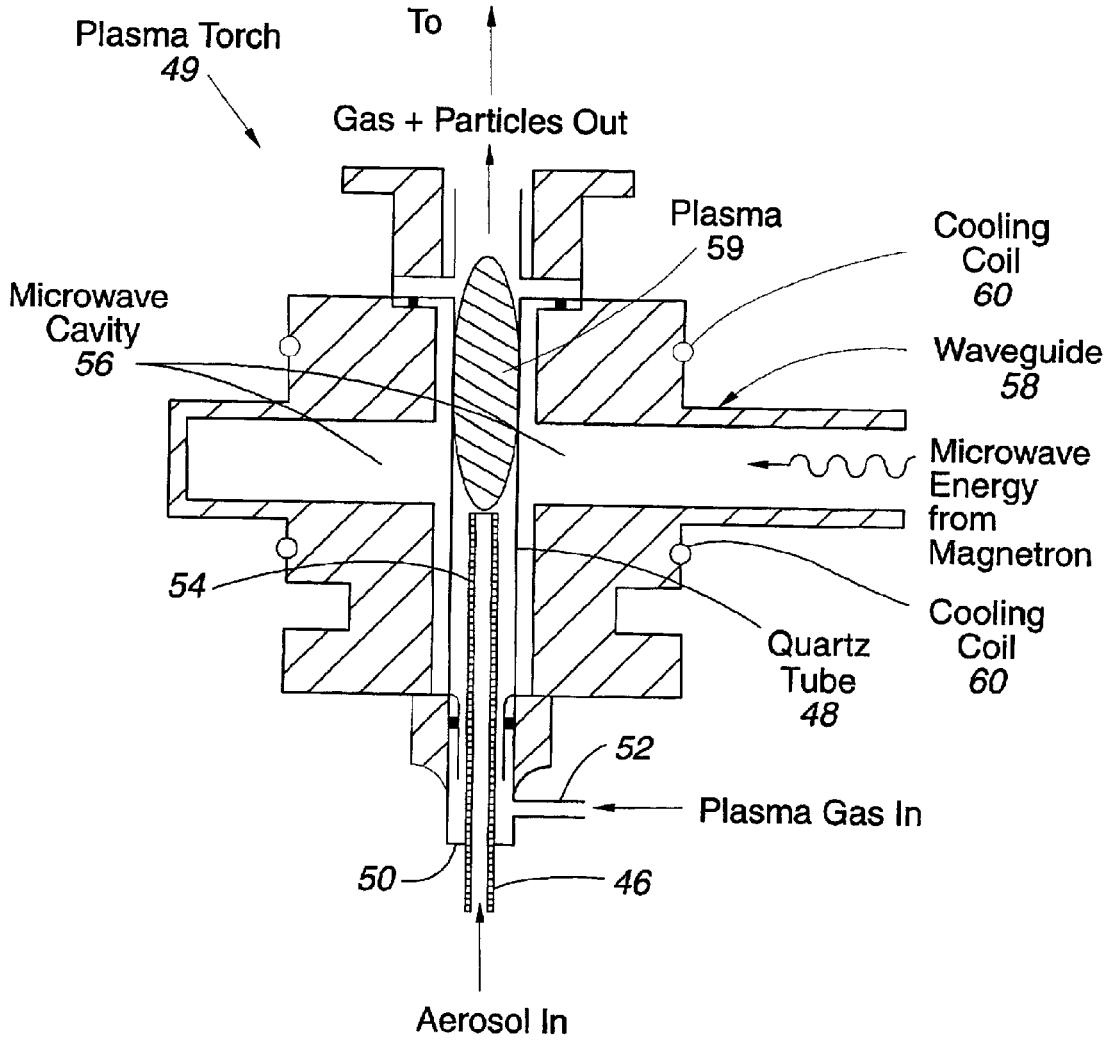
FIG. 2 shows a schematic, cross-sectional representation of a microwave plasma torch.
Figure 3:
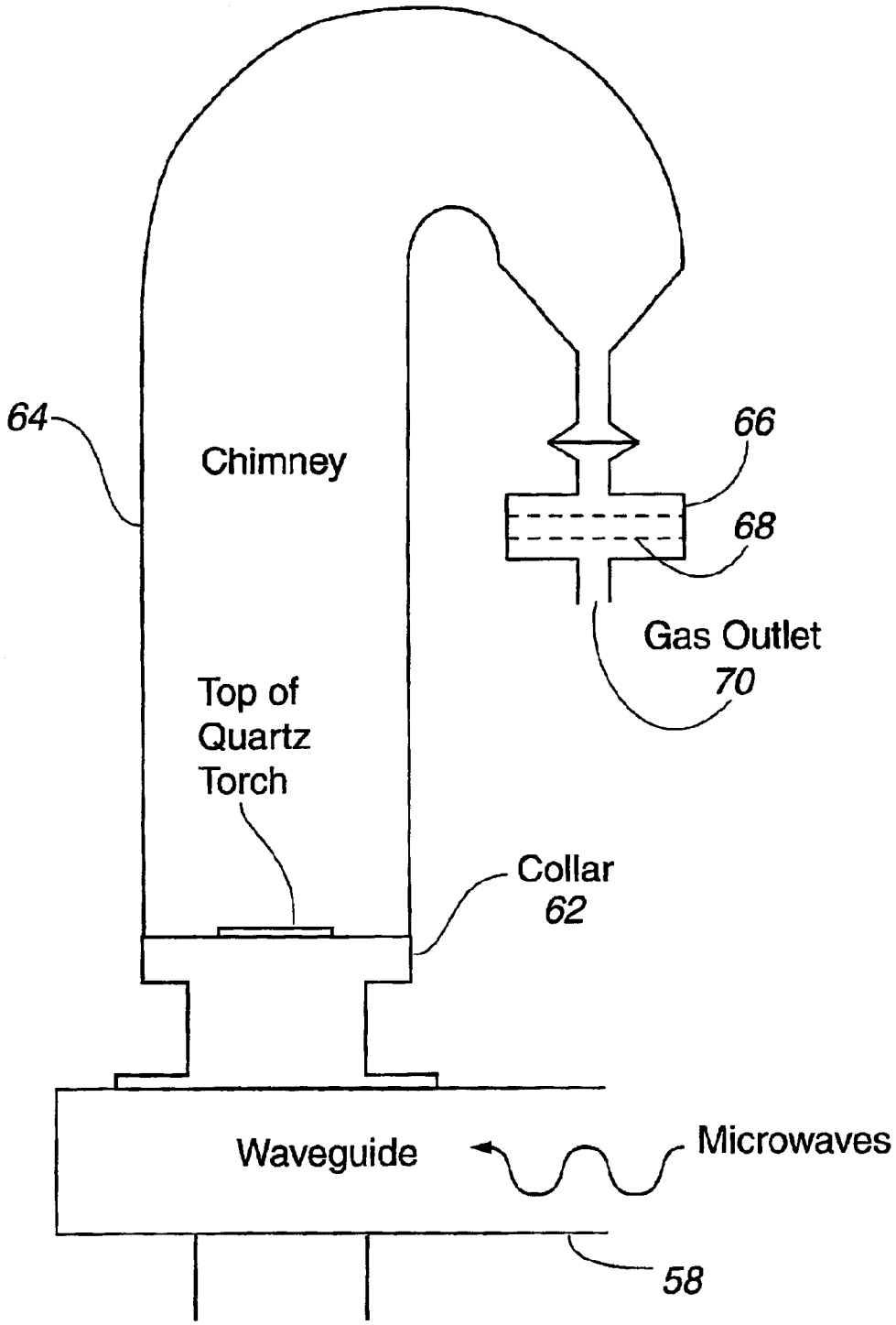
FIG. 3 shows a schematic representation of a particle collector.

Reference will now be made in detail to the present preferred embodiments of the invention, examples of which are illustrated in the accompanying drawings. Similar or identical structure is identified using identical callouts. FIGS. 1, 2, and 3 show the particle feeder, the plasma torch, and the particle collector of the apparatus used with the invention. Turning now to the Figures, FIG. 1 shows particle feeder 10, an inexpensive particle feeder constructed using parts commonly found in a laboratory. It should be understood that the main purpose of a particle feeder is to provide a metallic nanoparticle aerosol and to deliver the aerosol at a controlled rate to the plasma, and that other particle feeders that can accomplish this may be used instead of particle feeder 10. Particle feeder 10 includes particle reservoir 12 with aerosol gas inlet tube 14 and aerosol gas outlet tube 16. Inlet tube 14 and outlet tube 16 are flexible and supported by 2-hole rubber stopper 18, which blocks opening 20 of reservoir 12. Reservoir 12 contains a mixture of aluminum nanoparticles 22 and dispersing agents 24. Dispersing agents 24 are larger and heavier than nanoparticles 22. Dispersing agents may include, for example, ⅛-inch stainless steel balls and 100–150 micron-sized particles of silicon carbide. Dispersing particles 24 disperse nanoparticles 22 and remove any that adhere to the inner walls of reservoir 12. Nanoparticles 22 are also dispersed by aerosol gas entering reservoir 12 through inlet tube, which extends toward the bottom of reservoir 12 and into the nanoparticle/dispersing particle mixture.

A portion of particle feeder 10 moves reservoir 12 from side to side. This portion of the apparatus includes, in combination, diaphragm 26, dish 28, and foam pad 30. Dish 28 is engaged with diaphragm 26. Foam pad 30 is configured to fit inside dish 28 and also includes a portion configured to mate with a side portion of reservoir 12. Dish 28 includes hooks 32 for receiving the ends of elastic bands 34, which are wrapped around reservoir 12 to engage reservoir 12 to foam pad 26. As can be imagined from FIG. 1, when diaphragm 26 is made to oscillate, the oscillating motion is transferred to dish 28, to roam pad 30, and to reservoir 12. This motion contributes to the formation of the particle aerosol and to the removal of nanoparticles from the inside walls of reservoir 12. In practice, an audio speaker provided diaphragm 26, which was made to oscillate using audio amplifier 36. Amplifier 36 amplifies a signal generated by signal generator 38. Amplifier 36 and signal generator 38 were powered by power sources 40 and 42 respectively.

Nanoparticles may be introduced into reservoir through opening 20 by removing stopper 18. In this mode, nanoparticles are processed one batch at a time. Alternatively, to improve efficiency, apparatus 10 may be provided with a separate inlet for continuously replenishing nanoparticles 22 into reservoir 12 as they are processed according to the invention. A three-hole stopper could be used instead of two-hole stopper 18, where the third hole provides an inlet for introducing nanoparticles into the reservoir. Obviously, other inlet configurations are also possible.

Connector 44 (a Swagelock™ connector, for example) connects the upper end 46 of outlet tube 16 to ceramic tube 46. Ceramic tube 46 directs particle aerosol upward to the plasma torch. A schematic cross-sectional representation of plasma torch 49 is shown in FIG. 2. Ceramic tube 46 passes through coaxial outer quartz tube 48 of torch 49. Ceramic tube 46 seals against the lower end 50 of quartz tube 48. A non-aerosol-containing stream of plasma gas enters lower end 50 of quartz tube 48 through inlet 52. The upper end 54 of ceramic tube 46 extends into microwave cavity 56, where the aerosol stream, also called the injector gas flow, and the plasma gas stream, also called the primary gas flow, converge. Microwave energy generated by a magnetron (not shown) is directed through waveguide 58 into microwave cavity 56. The microwave energy interacts with the converged gas streams inside cavity 56 and transforms the gas into plasma 59. Cooling coils 60 surrounding torch 49 are provided with flowing cooling water to remove excess heat from the torch.

To demonstrate the invention, argon plasma gas entering through inlet 52 is ignited by microwave energy to form non-oxidizing plasma. Reservoir 12, shown in FIG. 1, is made to oscillate from side to side according to a sine waveform of predetermined frequency and amplitude. As reservoir 12 oscillates form side to side, aluminum nanoparticles 22 disperse and take on a cloudy appearance inside reservoir 12 while dispersing agents 24 aid in preventing them from adhering to each other and to the inner walls of reservoir 12. Aerosol gas enters particle reservoir 12 through inlet tube 14 and combines with the nanoparticles 22 inside to produce a nanoparticle aerosol that flows out of reservoir 12 through outlet tube 16, then upward through ceramic tube and into the torch 48. The nanoparticle aerosol exits upper end of ceramic tube 54 into the field region 56, and into plasma 59. As the nanoparticle aerosol passes through the plasma, the nanoparticles in the aerosol melt, collide, and join to form agglomerated, spherical, molten particles. The molten particles move upward and out of the plasma through collar 62, shown in FIG. 3, and into chimney 64 where they cool and continue moving into particle trap 66 where they are collected with particle filter 68. Plasma gas is vented out of particle trap 66 through exit port 70. Cooling water at about 5–10° C. is circulated throughout the plasma torch system so that the system can be operated continuously without overheating.

Figure 4:
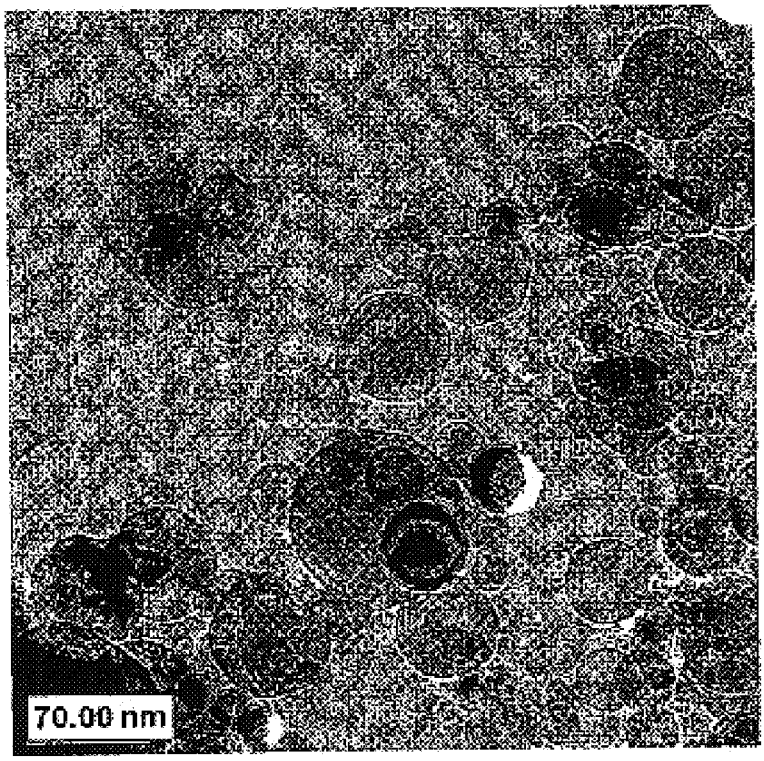
FIG. 4 shows a transmission electron micrograph image of aluminum nanoparticles.
Figure 5:
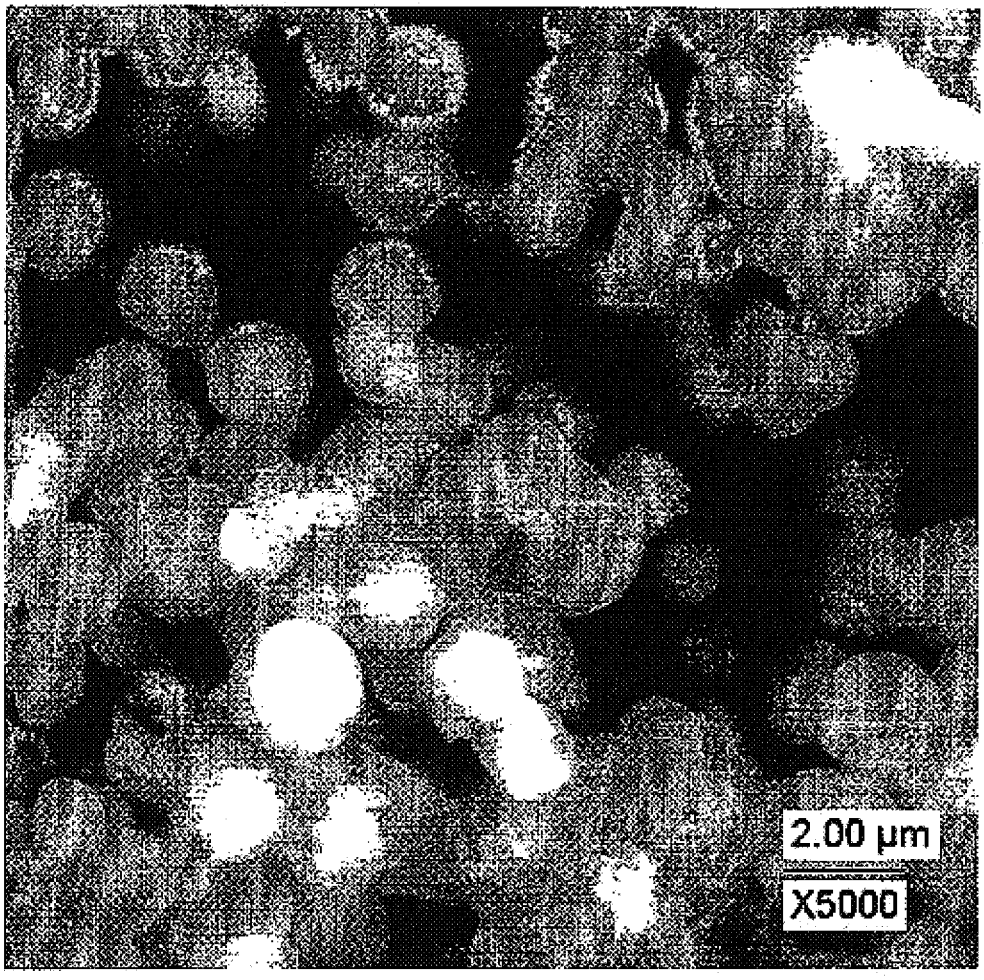
FIG. 5 shows a scanning electron micrograph image of aluminum particles produced from the nanoparticles of FIG. 4 according to the invention.
Figure 6:
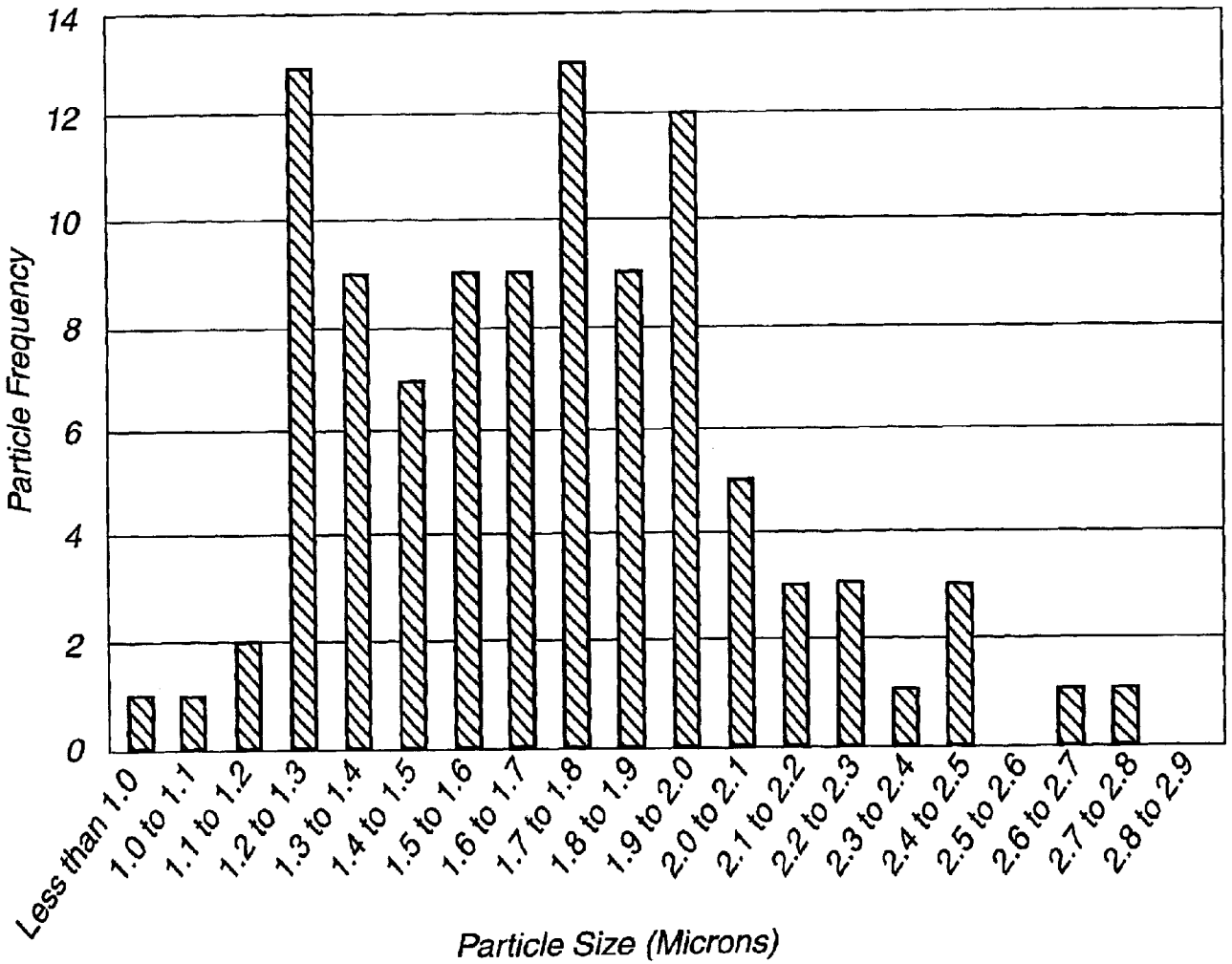
FIG. 6 shows a particle size distribution histogram for the metallic particles of FIG. 5.

FIG. 4 shows a transmission electron micrograph (TEM) image of aluminum nanoparticles of about 40–60 nanometers in diameter that were processed into larger, spherical (or nearly spherical) aluminum product particles according to the invention. The product aluminum particles were examined by x-ray diffraction, which indicated only the presence of aluminum metal. FIG. 5 shows a scanning electron micrograph (SEM: Hitachi S-800; software: S. Barrett, Image SXM) of the product aluminum particles. FIG. 6 shows a histogram of the product particle size distribution, plotted as particle frequency vs. particle size.

As FIG. 6 shows, all of the aluminum product particles fall within the size range of about 1–3 microns in diameter. Aluminum particles in this range are believed to be useful components for metallic paints typically used in automobiles, fingernail polish, and other commonly used products. What follows is a description of the specific conditions used to produce these particles. The primary gas and injector gas was argon. About 200–300 Watts of microwave power was used; this is near the lower limit required to maintain a stable argon plasma. The flow rate of the primary gas was either 0.3 or 0.6 liters per minute (lpm). The flow rate of the injector gas, which carries the entrained particles for melting and agglomeration, was 0.3 lpm. The terminal end of the central alumina injector tube was positioned nearly at the bottom of the coupler, which placed the particle injection point in a relatively cool region of the plasma and upstream from the hottest portion of the plasma. This arrangement allowed for a long residence time for particles in the hot zone. Under these conditions, a particle feed rate of about 5–10 mg/min was obtained at ambient pressure.

The above example illustrates the production of aluminum particles according to the invention. It should be understood that the invention can be used to convert smaller metallic nanoparticles into larger metallic particles for any solid metal or metal alloy. The invention can be used to convert metallic nanoparticles of, for example, alkaline earth metals Be, Mg, Ca, Sr, Ba, and Ra; transition metals Sc, Ti, V, Cr, Mn, Fe, Co, Ni, Cu, Zn, Y, Zr, Nb, Mo, Tc, Ru, Rh, Pd, Ag, Cd, La, Hf, Ta, W, Re, Os, Ir, Pt, and Au; lanthanide metals; actinide metals; and post transition metals that include Ga, In, Si, Ge, Pb, Sb, Te, and Bi, into larger particles. Nanoparticles of at least some of these metals are available by a variety of methods that include: gas evaporation (see K. Kimoto et al. in J. Appl. Phys. Vol. 2, p. 702, 1963; and W. Gong et al., J. Appl. Phys., vol. 69, no. 8, pp. 5119–5121); evaporation in a flowing gas stream (see S. Iwama et al., Nanostructured Materials, vol 1, pp 113–118, 1992; and S. Panda et al., Nanostructured Materials, vol. 5, nos. 7/8, pp. 755–767, 1995); mechanical attrition (see H. J. Fecht et al., Nanostructured Materials, vol. 1, pp. 125–130, 1992); sputtering (see V. Haas et al., Nanostructured Materials, vol. 1, pp. 491–504, 1002, 1993); electron beam evaporation (see J. A. Eastman et al., Nanostructured Materials, vol. 2, pp. 377–382, 1993); electron beam induced atomization of binary metal azides (see P. J. Herley et al., Nanostructured Materials, vol. 2, pp. 553–562, 1993); expansion of metal vapor in a supersonic free jet (see K. Recknagle et al., Nanostructured Materials, vol. 4, pp. 103–111, 1994); inverse micelle techniques (see J. P. Chen et al., Physical Review B, vol. 51, no. 17, pp. 527–532); laser ablation (see T. Yamamoto et al., Nanostructured Materials, vol. 7, no. 3, pp. 305–312, 1996); laser-induced breakdown of organometallic compounds (see T. Majima et al., Jpn. J. Appl. Phys., vol. 33, pp. 4759–4763, 1994); pyrolysis of organometallic compounds (see Y. Sawada et al., Jpn. J. Appl. Phys., vol 31, pp. 3858, 1992); and microwave plasma decomposition of organometallic compounds (see C. Chou et. al, J. Mat. Res., vol. 7, no. 8, pp. 2107–2113, 1992; J. R. Brenner et al., Nanostructured Materials, vol. 8, no. 1, pp. 1–17, 1997; and plasma induced size reduction of micron-sized metallic particles (J. Phillips et al. U.S. Pat. No. 10/017,289).

It should also be understood that while the description throughout refers to the use of microwave-generated argon plasmas, it is expected that other plasma systems can also be used. According to the invention, radiofrequency-generated and direct current (DC)-generated plasmas, for example, should also be capable of providing metallic particles.

Non-oxidizing plasmas are used with the invention to minimize the formation of metal oxides, metal carbides, and metal nitrides, all of which are both thermodynamically and kinetically favored at the temperatures required for the melting and agglomeration of metallic precursor particles. Non-oxidizing plasmas include plasmas produced from inert plasma gases such as helium, neon, argon, xenon, and nitrogen. Nitrogen gas can be used to generate plasmas that should be non-reactive with most metals. Even oxygen gas or the halogen gases can be used to form a non-oxidizing plasma for the appropriate choice of metals. Nanoparticles of metals that are especially resistant to oxidation could form using an oxygen plasma. Noble metals such as Pt, for example, are especially resistant to oxidation. The formation of Pt particles from Pt foil using oxygen plasma is described by C. H. Chou et al. in "Platinum Metal Etching in a Microwave Oxygen Plasma", J. Appl. Phys., vol. 68, no. 5, pp. 2415–2423, (1990).

In summary, the present invention provides a method for converting small precursor metallic nanoparticles into larger metallic particles having a relatively narrow particle size distribution. It is believed that the particle growth method of the invention is more effective in producing a narrow distribution of particles than known particle size reduction methods, at least partly, because particle agglomeration is more easily controlled than particle size reduction.

The foregoing description of the invention has been presented for purposes of illustration and description and is not intended to be exhaustive or to limit the invention to the precise form disclosed, and obviously many modifications and variations are possible in light of the above teaching. Commercially available particle feeders, for example, could be used instead of the particle feeder described herein.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for converting metallic nanoparticles into larger, spherical metallic particles, comprising the steps of:

(a) generating an aerosol of solid metallic precursor nanoparticles entrained in plasma gas, the nanoparticles consisting essentially of metal or oxide coated metal;

(b) generating a non-oxidizing plasma from plasma gas, the plasma comprising a portion sufficiently hot to melt the solid metallic precursor nanoparticles;

(c) directing the aerosol into the plasma and allowing the solid precursor metallic nanoparticles to melt, collide, join, and spheroidize to form larger molten, spherical, metallic particles; and (d) directing the molten, spherical, metallic microparticles away from the plasma so that they solidify and form larger, metallic, spherical, product particles.

2. The method of claim 1, wherein the metal is selected from the group consisting of Be, Mg, Ca, Sr, Ba, Ra, Sc, Ti, V, Cr, Mn, Fe, Co, Ni, Cu, Zn, Y, Zr, Nb, Mo, Tc, Ru, Rh, Pd, Ag, Cd, La, Hf, Ta, W, Re, Os, Ir, Pt, Au, Al, Ga, In, Sb, Pb, Te, Bi, larithanide metals, actinide metals, and alloys thereof.

3. The method of claim 1, wherein the non-oxidizing plasma comprises argon plasma, helium plasma, xenon plasma, nitrogen plasma, neon plasma, hydrogen plasma, or mixtures thereof.

4. The method of claim 1, wherein the plasma comprises oxygen plasma or halogen plasma.

5. The method of claim 1, where the plasma is generated from plasma gas at a gas pressure of about 0.001–100 atmospheres.

6. The method of claim 5, wherein the plasma is generated from plasma gas at a pressure of about 1 atmosphere.

7. The method of claim 1, wherein the plasma is generated by supplying at least 50 Watts of power to the plasma gas.

8. The method of claim 7, wherein the plasma is generated by a DC discharge.

9. The method of claim 7, wherein the plasma is generated using radiofrequency energy.

10. The method of claim 9, wherein the plasma is generated using microwave energy.

11. The method of claim 10, wherein the plasma is generated using about 200–300 watts of power.

12. The method of claim 1, wherein the product particles have a diameter of about 0.5–1000 microns.

13. A method for converting aluminum nanoparticles into larger, spherical aluminum particles, comprising the steps of:

(a) generating an aerosol comprising solid aluminum precursor nanoparticles entrained in plasma gas:

(b) generating a non-oxidizing plasma from plasma gas, the plasma comprising a portion sufficiently hot to melt the solid metallic precursor nanoparticles;

(c) directing the aerosol into the plasma and allowing the solid precursor aluminum nanoparticles to melt, collide, join, and spheroidize to form larger molten, soherical, aluminum particles; and (d) directing the molten, soherical, metallic microparticles away from the plasma so that they solidify and form larger, spherical, aluminum product particles comprising a diameter of about 0.5–3 microns.

* * * * *